US006672977B1

(12) United States Patent
Colbo et al.

(10) Patent No.: US 6,672,977 B1
(45) Date of Patent: Jan. 6, 2004

(54) MULTI-FUNCTIONAL GOLF ACCESSORY

(76) Inventors: Kenneth G. Colbo, 283 W. Front, Ste. 302, Missoula, MT (US) 59802; Marvin L. Zsupnik, 365 Lady Bug La., Corvallis, MT (US) 59828

( * ) Notice: Subject to any disclaimer, the term of this patent is extended or adjusted under 35 U.S.C. 154(b) by 0 days.

(21) Appl. No.: 10/193,855

(22) Filed: Jul. 11, 2002

(51) Int. Cl.[7] ..... A63B 57/00
(52) U.S. Cl. ..... 473/386; 294/19.2
(58) Field of Search ..... 473/386, 284, 473/286; 294/19.1, 19.2

(56) References Cited

U.S. PATENT DOCUMENTS

| | | | | |
|---|---|---|---|---|
| 2,943,856 A | | 7/1960 | Eimerman | |
| 3,904,200 A | | 9/1975 | Jackle et al. | |
| 4,526,369 A | * | 7/1985 | Phelps | 473/386 |
| 4,589,661 A | | 5/1986 | Attig | |
| 4,616,826 A | | 10/1986 | Trefts | |
| 4,714,250 A | | 12/1987 | Henthorn | |
| 4,819,938 A | | 4/1989 | Hill | |
| 4,949,961 A | | 8/1990 | Milano | |
| 4,951,947 A | | 8/1990 | Kopfle | |
| 5,080,357 A | | 1/1992 | Wolf | |
| 5,306,000 A | | 4/1994 | Comella | |
| 5,669,646 A | * | 9/1997 | Fiocca et al. | 473/386 |
| 5,707,303 A | * | 1/1998 | Berkowitz et al. | 473/386 |
| 6,338,685 B1 | * | 1/2002 | Posluszny | 473/386 |
| 6,394,515 B1 | * | 5/2002 | Keleher et al. | 473/386 |
| 6,447,407 B1 | * | 9/2002 | Caldwell | 473/286 |

* cited by examiner

*Primary Examiner*—Steven Wong
(74) *Attorney, Agent, or Firm*—Flanagan & Flanagan; John R. Flanagan

(57) ABSTRACT

A multi-functional golf accessory includes an elongated shaft, a handle attached to an upper end portion of the shaft, a ball teeing mechanism mounted to a lower end portion of the shaft, a trigger mounted to the handle, a motion transmitting rod extending through the shaft and coupling the handle with a pair of pivotal arms of the ball teeing mechanism for operating the arms for placing and releasing a ball and tee in a teed position on the ground, a tee height setting device and a ball retrieving device mounted on opposite sides of a housing of the ball teeing mechanism, a lying tee retrieving device and a standing tee retrieving device mounted to the ball retrieving device, and a quiver element removably storing a ball marking element mounted to the shaft.

28 Claims, 6 Drawing Sheets

10
14
14B
26A
26
42
46
40
12A
44
48
28
12
36
36A
38
38A
38B
68
4
14A
68A
70
12

MULTI-FUNCTIONAL GOLF ACCESSORY

BACKGROUND OF THE INVENTION

1. Field of the Invention

The present invention generally relates to accessories which are useful during playing of the game of golf and, more particularly, is concerned with a multi-functional golf accessory for use in performing golf ball teeing, marking and retrieving tasks, tee retrieving tasks and divot repairing tasks.

2. Description of the Prior Art

It has been estimated that an average golfer bends over more than seventy times during a round of golf. This poses a major problem for many golfers in that due to an assortment of medical conditions they experience pain in their back, hips and/or knees in stooping or bending from a standing position and so have difficulty in playing a round of golf. As a result, many of these golfers have little choice but to quit playing golf. Further, as the golfing population has an increasing number of seniors and handicapped golfers, there are more and more golfers who are unable to tee a golf ball properly, fix divots, mark golf balls, or pick up their tees.

A variety of devices have been proposed in the prior art to reduce the need for golfers to have to stoop or bend during a round of golf. Representative of such prior art devices are the ones disclosed in U.S. Pat. No. 2,943,856 to Eimerman, U.S. Pat. No. 3,904,200 to Jackle et al., U.S. Pat. No. 4,589,661 to Attig, U.S. Pat. No. 4,616,826 to Trefts, U.S. Pat. No. 4,714,250 to Henthorn, U.S. Pat. No. 4,819,938 to Hill, U.S. Pat. No. 4,949,961 to Milano, U.S. Pat. No. 4,951,947 to Kopfle, U.S. Pat. No. 5,080,357 to Wolf and U.S. Pat. No. 5,306,000 to Comella. While most of these prior art devices appear to be satisfactory in use for the specific purposes for which they were designed, none of them seem to provide a comprehensive solution for the problem at hand. The prior art devices fail to enable the performance of teeing of a golf ball, picking up tees, fixing divots, removing the golf ball from the cup or marking a golf ball on the green.

Consequently, a need still exists for an innovation which provides a comprehensive solution to the aforementioned problem without introducing any new problems in place thereof.

SUMMARY OF THE INVENTION

The present invention provides a multi-functional golf accessory designed to satisfy the aforementioned need. The multi-functional golf accessory of the present invention enables one to easily perform golf ball teeing, marking and retrieving tasks, tee retrieving tasks and divot repairing tasks and thereby eliminates the need for a golfer to stoop or bend during a round of golf. Specifically, by using the golf accessory of the present invention golfers are now able to easily tee a golf ball uniformly, pick up tees, fix divots on and off the green, mark balls on the green, and remove balls from the cup. Even golfers without physical handicaps will benefit from being able to tee the ball at a consistent height without canting the ball. Also, golf course managers will appreciate a device that allows all golfers the ability to easily fix their divots on the fairways as well as the greens.

Accordingly, the present invention is directed to a multi-functional golf accessory which comprises: (a) an elongated shaft having spaced apart upper and lower end portions; (b) a handle attached to the upper end portion of the shaft; (c) a ball teeing mechanism mounted to the lower end portion of the shaft and including a pair of arms being movable toward and away from one another between capture and release positions and having respective outer end portions defining respective elements extending in opposing relation to one another for capturing and holding a golf ball and a tee therebetween when the arms are moved toward one another to the capture position and for releasing the golf ball and tee therefrom when the arms are moved away from one another to the release position; (d) an actuating mechanism including a finger-actuatable trigger movably mounted to the handle and extending outwardly therefrom and means for movably coupling the trigger to the arms of the ball teeing mechanism such that in response to movement of the trigger in a first direction the arms are moved from the release position to the capture position whereas in response to movement of the trigger in a second direction opposite to the first direction the arms are moved from the capture position to the release position; (e) a tee height setting device mounted to a side of the ball teeing mechanism and being operable to preset the height at which the tee can be implanted into ground by the ball teeing mechanism; and (f) a ball retrieving device mounted to another side of the ball teeing mechanism opposite to the side thereof mounting the tee height setting mechanism, the ball retrieving device being pivotally movable between an upper storage position in which the ball retrieving device extends along the shaft and a lower retrieving position in which the ball retrieving device extends beyond the ball teeing mechanism for inserting into a cup to retrieve a ball therefrom.

The present invention is also directed to a multi-functional golf accessory which comprises: (a) an elongated shaft having spaced apart upper and lower end portions; (b) a handle attached to the upper end portion of the shaft; (c) a ball teeing mechanism including a housing attached to the lower end portion of the shaft and a pair of arms having respective inner end portions disposed interiorly of and mounted to the housing such that the arms are movable relative to the housing and toward and away from one another between capture and release positions, the arms also having respective outer end portions disposed exteriorly of the housing and defining respective elements extending in opposing relation to one another for capturing and holding a golf ball and a tee therebetween when the arms are moved toward one another to the capture position and for releasing the golf ball and tee therefrom when the arms are moved away from one another to the release position; (d) an actuating mechanism including (i) a finger-actuatable trigger movably mounted to the handle and extending outwardly therefrom, (ii) an elongated rod extending through the shaft and having opposite upper and lower ends, the rod at the upper end movably coupled to the trigger, and (iii) means for movably coupling the lower end of the rod to the inner end portions of the arms of the ball teeing mechanism such that in response to movement of the trigger and the rod therewith in a first direction the arms are moved from the release position to the capture position whereas in response to movement of the trigger and the rod therewith in a second direction opposite to the first direction the arms are moved from the capture position to the release position; and (e) a tee height setting device mounted to an exterior side of the housing of the ball teeing mechanism and being operable to preset the height at which the tee can be implanted into ground by the ball teeing mechanism.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
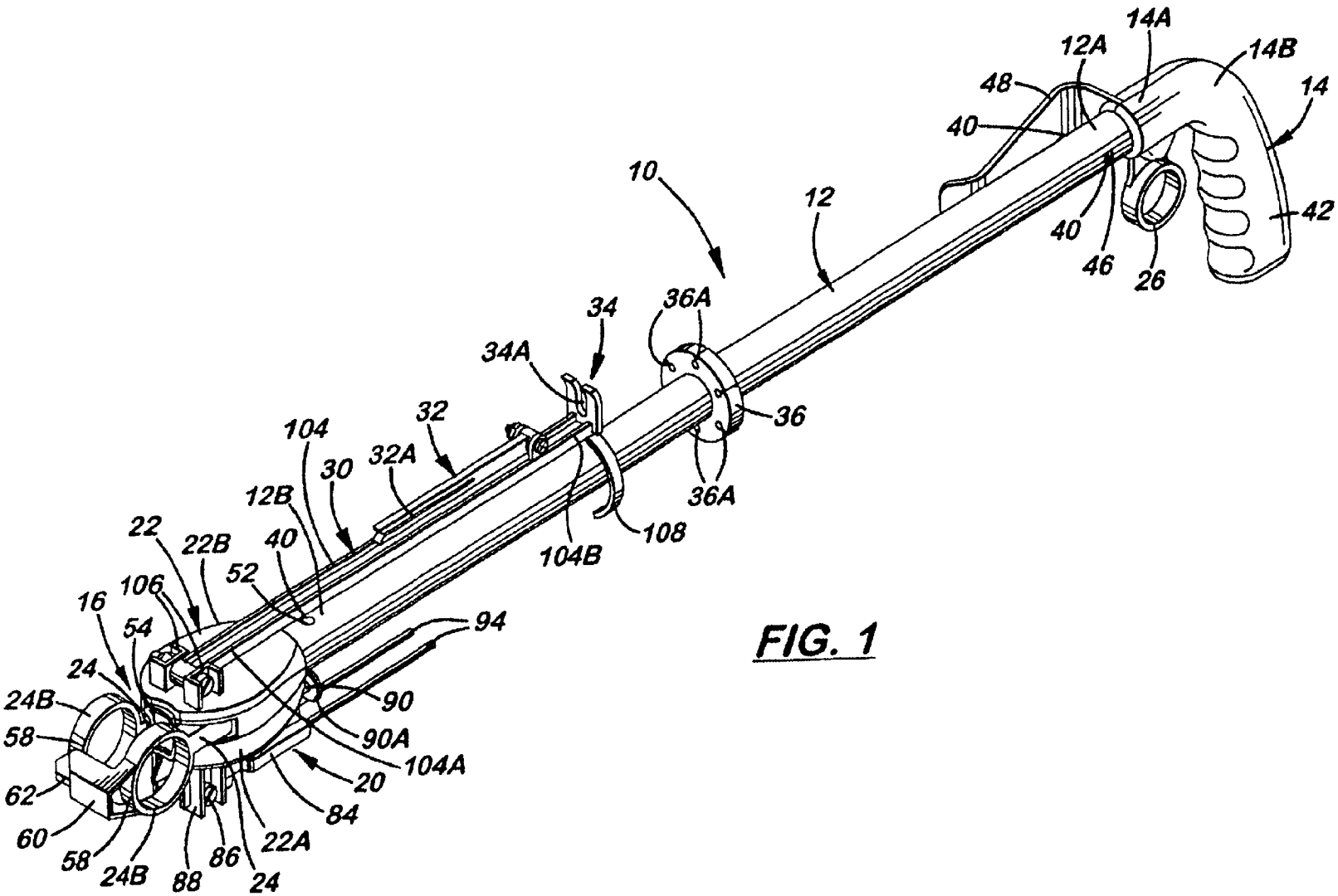
FIG. 1 is a perspective view of a multi-functional golf accessory of the present invention.
Figure 2:
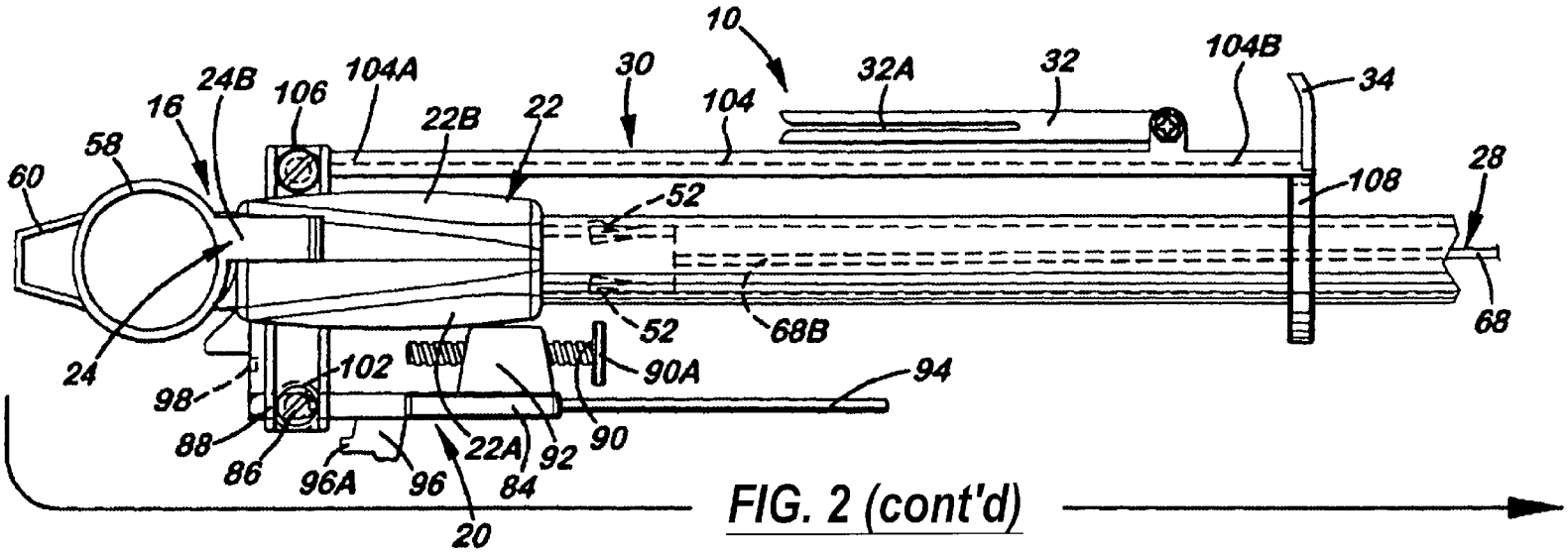
FIG. 2 is an enlarged side elevational view of the accessory.

Referring to the drawings and particularly to FIGS. 1 and 2, there is illustrated a multi-functional golf accessory of the present invention, generally designated 10. The accessory 10 is provided for use in performing golf ball teeing, marking and retrieving tasks, tee retrieving tasks and divot repairing tasks.

Figure 7:
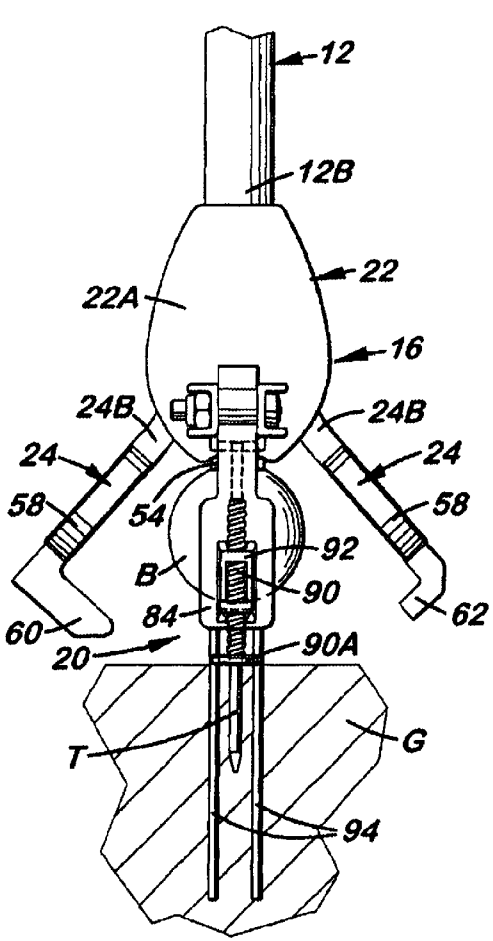
FIG. 7 is a fragmentary side elevational view of the accessory similar to that of FIG. 6, now depicting the pair of pivotal arms of the teeing mechanism in a release position.
Figure 6:
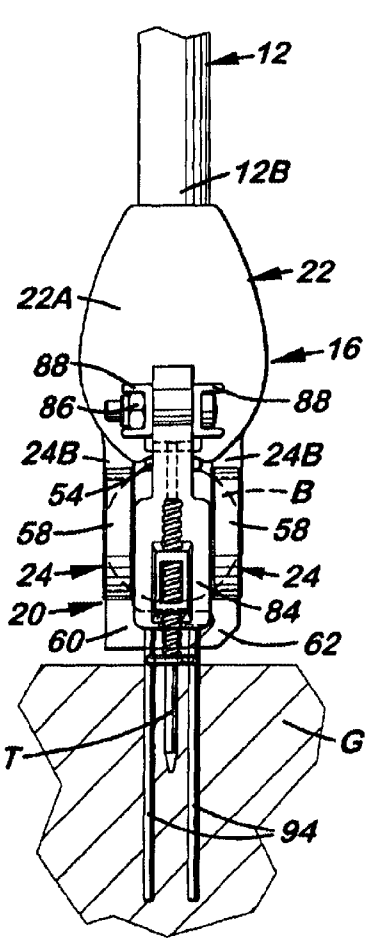
FIG. 6 is a fragmentary side elevational view of the accessory as seen along line 6—6 of FIG. 5, depicting a pair of pivotal arms of the teeing mechanism in a capture position.
Figure 5:
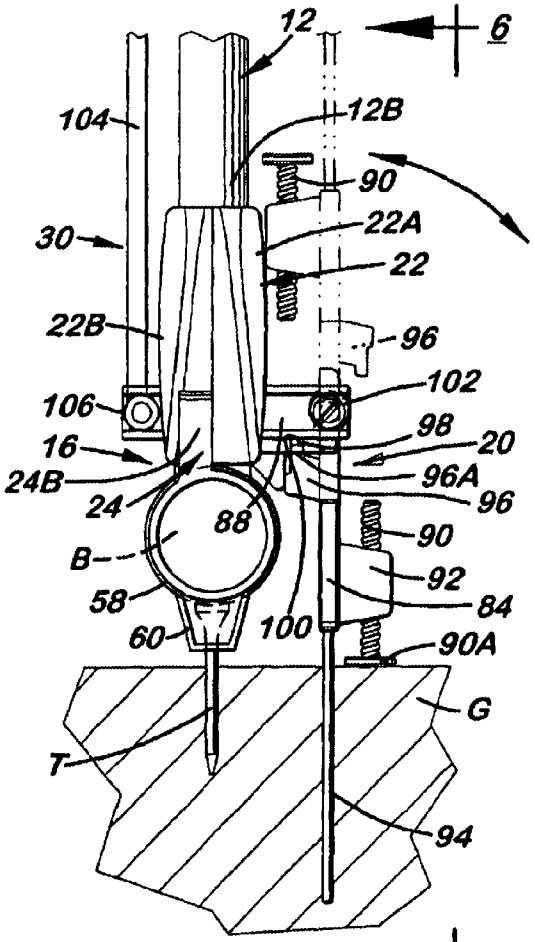
FIG. 5 is an enlarged fragmentary side elevational view of the accessory of FIG. 2, depicting after teeing of a golf ball on the ground the respective positions of a ball teeing mechanism which is mounted at a lower end portion of the shaft and of a tee height adjuster mechanism rotatably mounted to the teeing mechanism for movement between stored and deployed positions.
Figure 8:
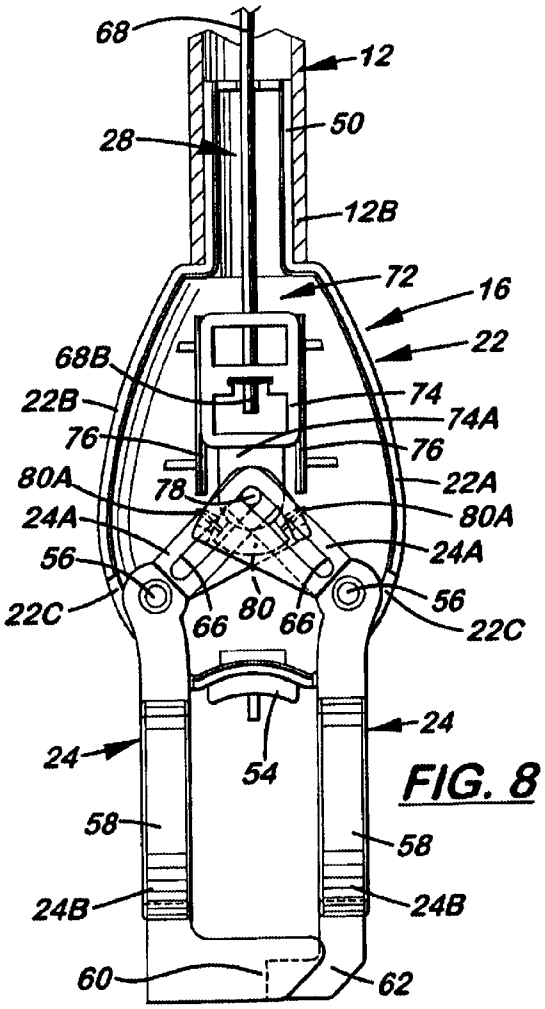
FIG. 8 is an enlarged fragmentary longitudinal sectional view of the accessory, with a housing of the teeing mechanism disassembled to show in the capture position of the pivotal arms of the teeing mechanism the relative position of the parts coupling a lower end of the motion-transmitting rod with upper end portions of the arms of the teeing mechanism.
Figure 9:
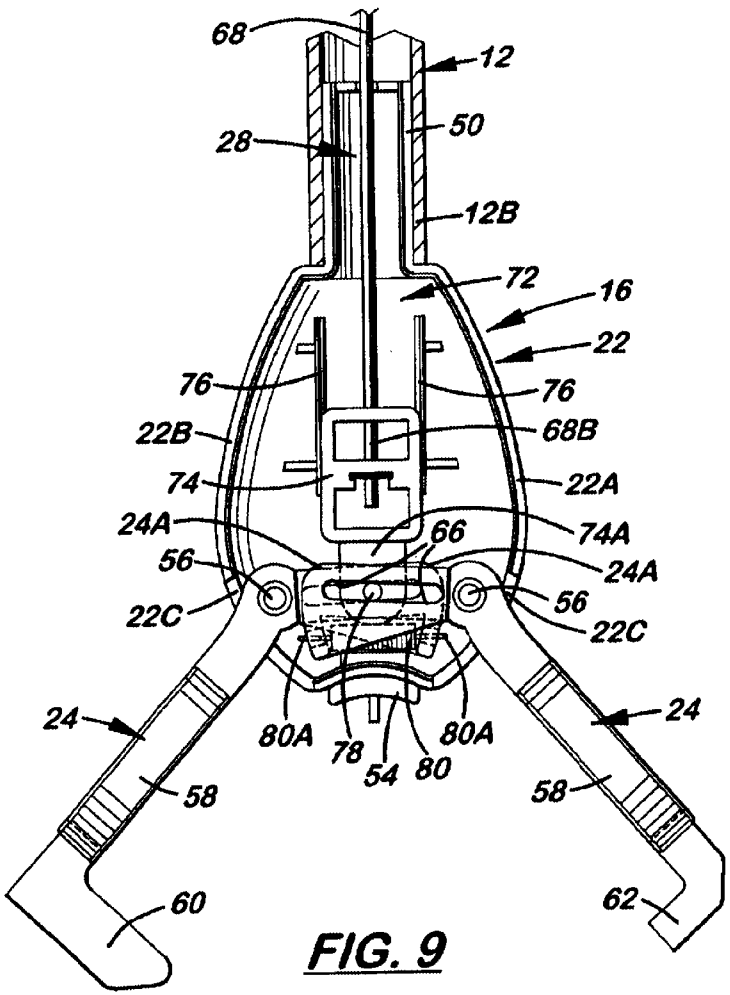
FIG. 9 is an enlarged fragmentary longitudinal sectional view of the accessary similar to that of FIG. 8, now showing in the release position of the arms of the teeing mechanism the relative position of the coupling parts.

Basically, the multi-functional golf accessory 10 includes an elongated shaft 12, a handle 14, a ball teeing mechanism 16, an actuating mechanism 18 and a tee height setting device 20. The handle 14 is attached to an upper end portion 12A of the shaft 12. The ball teeing mechanism 16 has a housing 22 mounted to a lower end portion 12B of the shaft 12 and a pair of arms 24 pivotally mounted to the housing 22 and pivotally movable between a ball-and-tee capture position, as seen in FIGS. 6 and 8, and a ball-and-tee release position, as seen in FIGS. 7 and 9. The actuating mechanism 18 includes a finger-actuatable trigger 26 pivotally mounted to the handle 14 and a motion-transmitting arrangement 28 extending through the shaft 12 and housing 22 and coupled to the pivotal arms 24 of the ball teeing mechanism 16 for operating the arms 24, in conjunction with the tee height setting device 20, to capture, place and then release a golf ball B and a tee T in a teed position on the ground G, as seen in FIGS. 5–7. The term "ground" is used in a general sense to mean any areas of both golf courses and practice ranges. The. tee height setting device 20 is mounted to the housing 22 of the ball teeing mechanism 16. The accessory 10 may also include a ball retrieving device 30 mounted on the housing 22 of the ball teeing mechanism 16, a lying tee retrieving device 32 and a standing tee retrieving device 34 mounted to the ball retrieving device 30, and a quiver element 36 mounted about the shaft 12 and removably storing a ball marking element 38.

Referring now to FIGS. 1–9, the shaft 12 of the accessory 10 is of hollow construction and each of the upper and lower end portions 12A, 12B thereof has a pair of opposing apertures 40 defined therein. The handle 14 of the accessory 10 is made up of a pair of handle parts 14A, 14B which are mirror images of and interf it with one another to form a grip portion 42 and a stub shaft portion 44 integrally merging from the grip portion 42 which fits into the upper end portion 12A of the hollow shaft 12. The stub shaft portion 44 inserts into the upper end portion 12A of the shaft 12 and is releasably attached thereto by the action of a pair of depressible buttons 46 integrally formed on the opposite sides of the stub shaft portion 44 and adapted to snap fit into the apertures 40 in the upper end portion 12A of the shaft 12. The accessory 10 also includes a clip 48 attached to the one handle part 14A of the handle 14. The clip 48 is disposed adjacent to the upper end portion 12A of the elongated shaft 12 and extends along the shaft 12 below the handle 14. In such position, the clip 48 is adapted to facilitate hanging the accessory 10 on a golf bag. Alternatively the clip 48 could be attached to the upper end portion 12A of the shaft 12 below the handle 14.

The housing 22 of the ball teeing mechanism 16 of the accessory 10 is made up of a pair of housing parts 22A, 22B which are mirror images of and interfit with one another to form the housing 22 and a stub shaft portion 50 integrally merging from the housing 22 which fits into the lower end portion 12B of the hollow shaft 12. The stub shaft portion 50 inserts into the lower end portion 12B of the shaft 12 and is releasably attached thereto by the action of a pair of depressible buttons 52 integrally formed on the opposite sides of the stub shaft portion 44 and adapted to snap fit into the apertures 40 in the upper end portion 12A of the shaft 12. The housing 22 also has a concave-shaped ball seat 54 formed on an outer end thereof for engaging a top portion of the golf ball B opposite from the tee T when the arms 24 of the ball teeing mechanism 16 are in the capture position, as seen in FIGS. 6 and 7.

Figure 17:
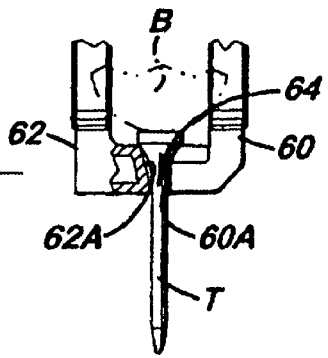
FIG. 17 is an enlarged fragmentary side elevational view of the arms of the teeing mechanism in the capture position of FIGS. 5 and 6, depicting respective tee holding elements cooperating with one another so as to hold the tee upwardly against the bottom of a golf ball.
Figure 16:
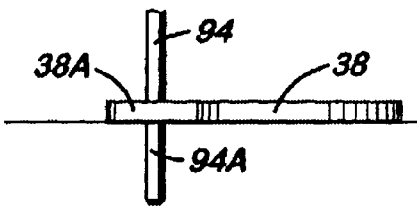
FIG. 16 is a side elevational view of the ball marking element deployed on the one guide pin as seen along line 16—16 of FIG. 15.
Figure 15:
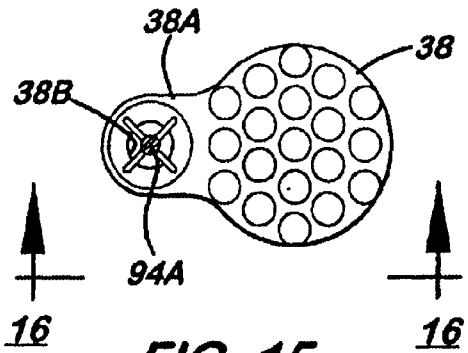
FIG. 15 is an enlarged plan view of the ball marking element removed from the quiver element and deployed on one of a pair of guide pins of the tee height setting device.
Figures 2, 3, 4:
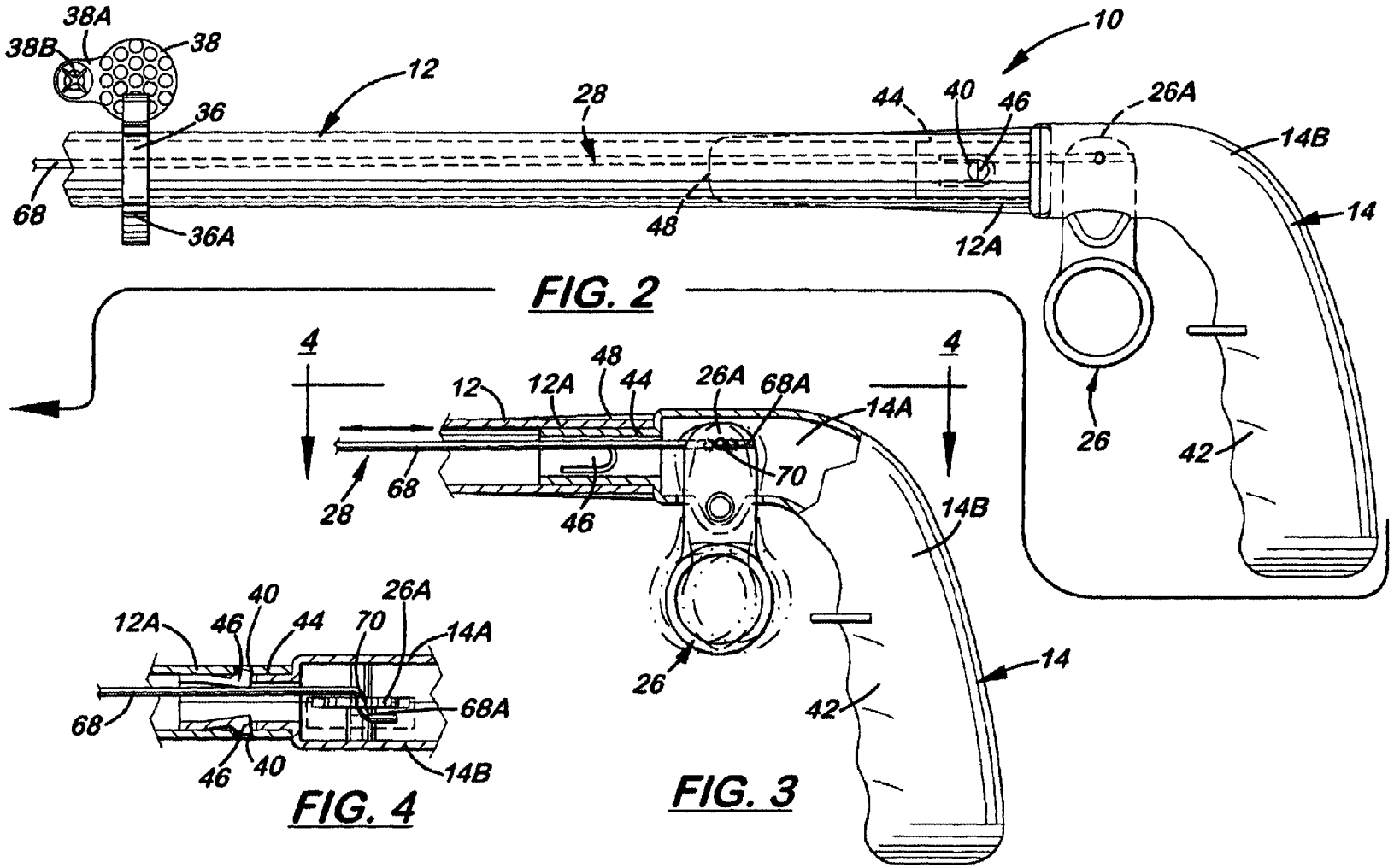
FIG. 3 is a fragmentary view of the accessory of FIG. 2, depicting a handle and an upper end portion of a shaft which mounts the handle broken away to show a finger-actuatable trigger pivotally mounted to the handle and an upper end of a motion-transmitting rod coupled to the handle trigger.
FIG. 4 is a fragmentary longitudinal sectional view of the accessory taken along line 4—4 of FIG. 3.

The arms 24 of the ball teeing mechanism 16 of the accessory 10 have respective inner end portions 24A disposed interiorly of and pivotally mounted on respective posts 56 in the housing 22 such that the arms 24 are pivotally movable relative to the housing 22 and toward and away from one another between the ball-and-tee capture and release positions, as respectively seen in FIGS. 8 and 9. The arms 24 also have respective outer end portions 24B extending through notches 22C formed in the housing parts 22A, 22B and disposed exteriorly of the housing 22. The outer end portions 24B of the arms 24 define respective first elements 58 which are substantially identical to one another and extend in opposing relation to one another for engaging, capturing and holding a golf ball B therebetween when the arms 24 are moved toward one another to the capture position of FIGS. 5–8 and 17. The first elements 58 also disengage from and release the golf ball B when the arms 24 are moved away from one another to the release position of FIG. 9. The first elements 58 have respective circular configurations and are disposed adjacent to one another in the capture position for effectively capturing and holding the ball B therebetween, as seen in FIGS. 1, 2 and 5. The outer end portions 24B of the arms 24 also define respective second elements 60, 62 located below and integrally attached to the first circular elements 58. The second elements 60, 62 are shaped complementary to one another for meshing or interfitting and cooperating with one another, as seen in FIGS. 6–8 and 17, to hold the tee T therebetween. Specifically, the second elements 60, 62 together define a passage 64 between them having respective sidewalls 60A, 62A being shaped for accommodating and holding a tee T of various shapes in an upright fashion below the ball B and causing the tee T to lift or move slightly upwardly toward the ball B held between the first circular elements 58 when the pivotal arms 24 are placed in the ball-and-tee capture position, as seen in FIG. 17, so as to facilitate the insertion of the tee T in the ground G while the ball B is held seated on the tee T. The outer end portions 24B of the arms 24, and thus the first and second elements 58, 60, 62 can be move from the capture position away from one another to the release position once the ball B and tee T have been teed up, as seen in FIG. 5.

Additionally, the inner end portions 24A of the arms 24 each has an elongated slot 66 defined therein. The movable motion-transmitting arrangement 28 of the actuating mechanism 18 includes an elongated rod 68 which extends through the hollow shaft 12 and is attached at an upper S-shaped end 68A of the rod 68 to an inner end 26A of the trigger 26 by extending through a hole 70 therein. The arrangement 28 also includes a coupling means 72 in the form of a slidable link 74 slidably mounted by a track 76 formed by the housing parts 22A, 22B. A lower end 68B of the rod 68 is fastened to the slidable link 74 which, in turn, has an outer end 74A mounting a pin 78 therethrough. The opposite ends 78A of the pin 78 are slidably engaged with inner end portions 24A of the arms 24 through their slots 66 such that upon movement of the trigger 26 by a user's finger (and thus the rod 68 and slidable link 74 therewith) by pushing forwardly or pulling rearwardly on the trigger 26 the arms 24 are correspondingly pivotally moved between the capture and release positions, as respectively seen in FIGS. 8 and 9, by the inner end portions 24A of the arms 24 being caused to pivot relative to the pin 78 as the pin 78 moves relative to and along the slots 66. The coupling means 72 also has a yieldably deformable spring 80 disposed adjacent to the inner end portions 24A of the arms 24 and having opposite ends 80A each respectively attached to one of the inner end portions 24A of the arms 24 such that the spring 80 exerts a force when the arms 24 are disposed at either of their capture position of FIG. 8 or their release position of FIG. 9 that tends to hold the arms 24 at the respective positions so that a counterforce must be exerted by a user to move the trigger 26 and the rod 68 therewith in order to overcome the force exerted by the spring 80 and cause the arms 24 to move away from one of the respective positions to the other of the respective positions.

The tee height setting device 20 of the accessory 10 is pivotally movable relative to the housing 22 between an upward extending storage position, as seen in FIGS. 1, 2 and 5, and a downward extending operative or use position, as seen in FIGS. 5–7. More particularly, the tee height setting device 20 includes an elongated mounting member or bracket 84 pivotally mounted by a fastener 86 between a pair of posts 88 fixedly or integrally attached on and projecting outwardly from the exterior side of the one housing part 22A of the teeing mechanism housing 22 such that the mounting bracket 84 can undergo pivotal movement relative to the housing 22 between the upwardly extending storage position and the downwardly extending use position. The tee height setting device 20 also includes a tee height adjusting element 90 threadably mounted through a side lug 92 formed on the mounting bracket 84 so as to undergo rotation in order to move the tee height adjusting element 90 longitudinally along the mounting bracket 84. The tee height setting device 20 further includes a pair of elongated guide pins 94 mounted on the mounting bracket 84 in a generally side-by-side relation with one another and adjacent to the tee height adjusting element 90 and extending outwardly beyond the lower end of the mounting bracket 84 and the tee height adjusting element 90 such that the guide pins 94 can be pushed into the ground G at the desired angle with the ground until a head 90A of the tee height adjusting element 90 contacts the ground G to set the height at which the tee T will be implanted into the ground G by the ball teeing mechanism 16. By screwing the tee height adjusting element 90 relative to the side lug 92 on the mounting bracket 84 the depth at which the pins 94, and thus the tee T, can be inserted into the ground G can be varied and set. The spaced apart guide pins 94 are also adapted to be inserted into the ground G for replacing and repairing divits and also inserted into the ground to support the accessory 10 in a self-standing orientation.

The tee height setting device 20 also includes a latch 96 integrally or fixedly attached on a side of the. mounting bracket 84 opposite that of the side lug 92 and adapted to be inserted into a recess 98 formed in an end wall 100 fixed to and extending between the posts 88. The posts 88 have openings 102 through which the fastener 86 extends which are sufficiently larger in diameter than the fastener 86 so as to provide enough lateral movement of the fastener 86 relative to the posts 88 to allow the tip end 96A of the latch 96 to be inserted into the recess 98 to temporarily lock the tee height setting device 20 in the operative or use position, as shown in FIG. 5, as the guide pins 94 are forced downward into the ground G during teeing of the ball B.

Figure 13:
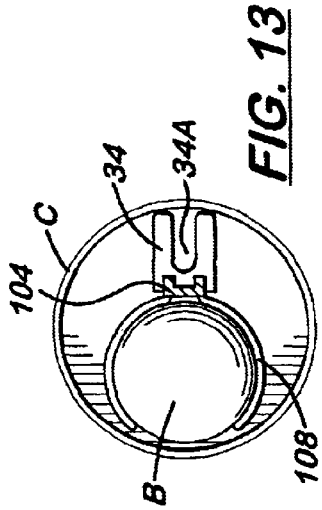
FIG. 13 is a top plan view of the ball retrieving device as seen along line 13—13 of FIG. 12.
Figure 12:
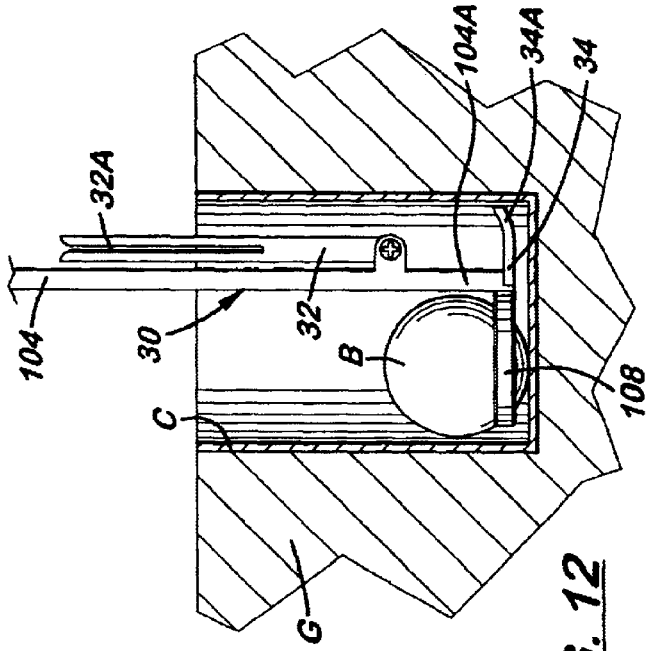
FIG. 12 is still another fragmentary side elevational view of the ball retrieving device now disposed in the lower ball retrieving position in which a C-shaped expandable element of the device is disposed underlying a golf ball in a cup with the ball in a seated position thereon ready to be lifted from the cup.
Figure 10:
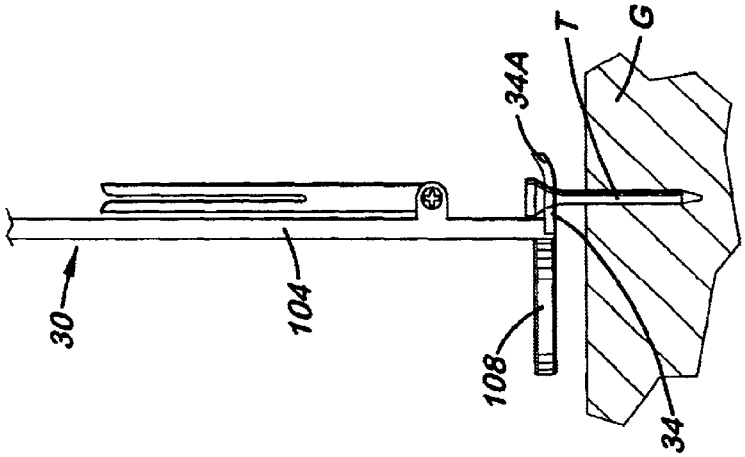
FIG. 10 is a fragmentary side elevational view of a ball retrieving device pivotally mounted to the housing of the teeing mechanism and disposed in a lower ball retrieving position in which a standing tee retrieving device fixedly attached to and extending outwardly from a lower end of the ball retrieving device is depicted retrieving a standing tee from the ground.

Referring to FIGS. 1, 2, 5 and 10–13, the ball retrieving device 30 of the accessory 10 is mounted to the exterior side of the housing 22 opposite from the tee height setting device 20 so as to be pivotally movable between an upper storage position, seen in FIGS. 1 and 2, in which the ball retrieving device 30 extends along the shaft 12 and a lower retrieving position, as seen in FIGS. 10 and 12, in which the ball retrieving device 30 extends beyond the ball teeing mechanism 16 for inserting into a cup C to retrieve a ball B therefrom. More particularly, the ball retrieving device 30 includes an elongated member 104 pivotally mounted at one end 104A by another pair of posts 106 fixed on the exterior side of the other housing part 22B, and an expandable element 108, generally C-shaped in configuration, attached to an opposite end 104B of the elongated member 104 and being capable of flexing, when the device 30 is in the lower retrieving position, so as to fit around a ball B in the cup C and underlie the ball B, as seen in FIGS. 12 and 13, for lifting the ball B from the cup C.

Figure 11:
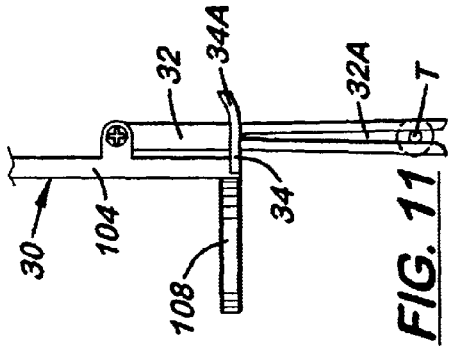
FIG. 11 is another fragmentary side elevational view of the ball retrieving device disposed in the lower ball retrieving position in which a laying tee retrieving device pivotally mounted and extending outwardly from a side of the lower end of the ball retrieving device is depicted in a deployed position retrieving a lying tee from the ground.
Figure 14:
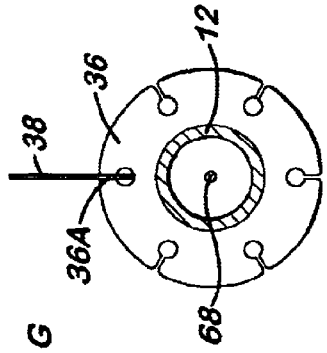
FIG. 14 is an enlarged plan view of a quiver element and a ball marking element held by the quiver element as seen along line 14—14 of FIG. 2.

Referring to FIGS. 1, 2 and 10–12, the lying tee retrieving device 32 of the accessory 10 is pivotally mounted to the elongated member 104 of the ball retrieving device 30 and is movable between a storage position adjacent to the elongated member 104, as seen in FIG. 10, and a use position, as seen in FIG. 11, where the device 32 extends downwardly beyond the elongated member 104. The lying tee retrieving device 32 preferably has a bifurcated end portion 32A adapted for receiving a lying tee T therethrough so that it can be lifted off the ground.

The standing tee retrieving device 34 of the accessory 10 is fixedly attached to and extending rearwardly outwardly from the opposite end 104B of the elongated member 104 of the ball retrieving device 30 opposite from the C-shaped expandable element 108 thereon. Preferably, the standing tee retrieving device 34 also has a bifurcated end portion 34A adapted for receiving a standing tee T therethrough so that it can be lifted from the ground.

Referring to FIGS. 1, 2, 15 and 16, the ball marking element 38 is removably attached on the quiver element 36 which is fitted over the elongated shaft 12. The ball marking element 38 has a tab 38A thereon with an opening 38B defined therethrough which can receive an end 94A of one of the guide pins 94 to place the marking element 38 on the ground and also to pick it up. The quiver element 36, which is of annular shape and is fitted over the shaft 12, has a plurality of radial slits 36A therein which are open at an outer periphery of the quiver element 36 and terminate before reaching an inner periphery of the quiver element 36. The ball marking element 38 is removably fitted into any one of the slits 36A of the quiver element 36.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A multi-functional golf accessory, comprising:

(a) an elongated shaft having spaced apart upper and lower end portions;

(b) a handle attached to said upper end portion of said shaft;

(c) a ball teeing mechanism mounted to said lower end portion of said shaft and including a pair of arms being movable toward and away from one another between capture and release positions and having respective outer end portions defining respective elements extending in opposing relation to one another for capturing and holding a golf ball and a tee therebetween when said arms are moved toward one another to said capture position and for releasing the golf ball and tee therefrom when said arms are moved away from one another to said release position;

(d) an actuating mechanism including a finger-actuatable trigger movably mounted to said handle and extending outwardly therefrom and means for movably coupling said trigger to said arms of said ball teeing mechanism such that in response to movement of said trigger in a first direction said arms are moved from said release position to said capture position whereas in response to movement of said trigger in a second direction opposite to said first direction said arms are moved from said capture position to said release position;

(e) a tee height setting device mounted to a side of said ball teeing mechanism and being operable to preset the height at which the tee can be implanted into ground by said ball teeing mechanism; and (f) a ball retrieving device mounted to said ball teeing mechanism opposite to said side thereof mounting said tee height setting mechanism, said ball retrieving device being pivotally movable between an upper storage position in which said ball retrieving device extends along said shaft and a lower retrieving position in which said ball retrieving device extends beyond said ball teeing mechanism for inserting into a cup to retrieve a ball therefrom.

2. The accessory of claim 1 wherein said tee height setting device includes:

a mounting bracket mounted to a housing of said ball teeing mechanism for undergoing pivotal movement relative to said housing between an upwardly extending storage position and a downwardly extending use position;

a tee height adjusting element mounted to said mounting bracket so as to undergo rotation in order to move said element longitudinally along said mounting bracket; and a pair of guide pins mounted on said mounting bracket in a generally side-by-side relation with one another and adjacent to said tee height adjusting element and extending outwardly beyond said mounting bracket and said tee height adjusting element such that said guide pins can be pushed into the ground until said tee height adjusting element contacts the ground to set the height at which the tee will be implanted into the ground by the ball teeing mechanism.

3. The accessory of claim 2 wherein said guide pins are also adapted to be inserted into the ground for replacing and repairing divits in a playing surface.

4. The accessory of claim 2 further comprising:

an annular quiver element fitted over said shaft and having at least one radial slit therein; and a ball marking element removably fitted into said one slit of said quiver element, said ball marking element having a tab with an opening which can receive an end of one of said guide pins to place said ball marking element on the ground and also to pick up said ball marking element from the ground.

5. The accessory of claim 1 wherein said ball retrieving device includes:

an elongated member pivotally attached at one end to a housing of said ball teeing mechanism; and an expandable element attached to an opposite end of said elongated member and being capable of flexing so as to fit around a ball in the cup and underlie the ball for lifting the ball from the cup.

6. The accessory of claim 5 further comprising:

a lying tee retrieving device pivotally mounted to said elongated member of said ball retrieving device and being movable between a storage position adjacent to said elongated member and a use position extending outwardly from said elongated member, said lying tee retrieving device having a bifurcated end portion adapted for receiving a lying tee therethrough.

7. The accessory of claim 6 further comprising:

a standing tee retrieving device spaced from said lying tee retrieving device and fixedly attached to and extending rearwardly outwardly from said opposite end of said elongated member of said ball retrieving device, said standing tee retrieving device having a bifurcated end portion adapted for receiving a standing tee therethrough.

8. The accessory of claim 5 further comprising:

a standing tee retrieving device fixedly attached to and extending rearwardly outwardly from said opposite end of said elongated member of said ball retrieving device opposite from said expandable element thereon, said standing tee retrieving device having a bifurcated end portion adapted for receiving a standing tee therethrough.

9. The accessory of claim 1 further comprising:

a clip attached to one of said handle and said upper end portion of said shaft and extending therealong to facilitate hanging said accessory on a golf bag.

10. A multi-functional golf accessory, comprising:

(a) an elongated shaft having spaced apart upper and lower end portions;

(b) a handle attached to said upper end portion of said shaft;

(c) a ball teeing mechanism including a housing attached to said lower end portion of said shaft and a pair of arms having respective inner end portions disposed interiorly of and pivotally mounted to said housing interiorly thereof such that said arms are movable relative to said housing and toward and away from one another between capture and release positions, said arms also having respective outer end portions disposed exteriorly of said housing and defining respective elements extending in opposing relation to one another for capturing and holding a golf ball and a tee therebetween when said arms are moved toward one another to said capture position and for releasing the golf ball and tee therefrom when said arms are moved away from one another to said release position;

(d) an actuating mechanism including (i) a finger-actuatable trigger movably mounted to said handle and extending outwardly therefrom, (ii) an elongated rod extending through said shaft and having opposite upper and lower ends, said rod at said upper end movably coupled to said trigger, and (iii) means for movably coupling said lower end of said rod to said inner end portions of said arms of the ball teeing mechanism such that in response to movement of said trigger and said rod therewith in a first direction said arms are moved from said release position to said capture position whereas in response to movement of said trigger and said rod therewith in a second direction opposite to said first direction said arms are moved from said capture position to said release position, said inner end portions of said arms each also having an elongated slot defined therein, said movably coupling means being attached to said lower end of said rod and having a pin slidably engaged with said inner end portions of said arms through said slots therein such that upon movement of said trigger and said rod therewith in said first and second directions said arms are pivotally moved between said capture and release positions by said inner end portions of said arms being caused to pivot relative to said pin as said pin moves relative to and along said slots; and (e) a tee height setting device mounted to an exterior side of said housing of said ball teeing mechanism and being operable to preset the height at which the tee can be implanted into ground by said ball teeing mechanism.

11. The accessory of claim 10 further comprising:

a clip attached to one of said handle and said upper end portion of said shaft and extending therealong to facilitate hanging said accessory on a golf bag.

12. The accessory of claim 10 wherein said handle has a pair of handle parts which interfit with one another to form said handle.

13. The accessory of claim 10 wherein said shaft is hollow and has a pair of opposing apertures defined in each of said upper and lower end portions of said shaft.

14. The accessory of claim 13 wherein said handle includes:

a stub shaft portion removably inserted into said upper end portion of said shaft; and a pair of depressible buttons formed on opposite sides of said stub shaft portion and releasably snap fitted into said apertures so as to releasably attach said handle to said upper end portion of said shaft.

15. The accessory of claim 13 wherein said housing of said ball teeing mechanism includes:

a stub shaft portion removably inserted into said lower end portion of said shaft; and a pair of depressible buttons formed on opposite sides of said stub shaft portion and releasably snap fitted into said apertures so as to releasably attach said housing to said lower end portion of said shaft.

16. The accessory of claim 10 wherein said housing of said ball teeing mechanism includes a pair of housing parts which interfit with one another to form said housing.

17. The accessory of claim 10 wherein said housing of said ball teeing mechanism has a concave ball seat formed on an outer end thereof for engaging a portion of the golf ball opposite the tee when said arms of said ball teeing mechanism are in said capture position.

18. The accessory of claim 10 wherein a pair of said elements defined by said outer end portions of said arms of said ball teeing mechanism are circular in configuration and adapted to hold a golf ball therebetween when said arms are disposed in said capture position.

19. The accessory of claim 18 wherein another pair of said elements defined by said outer end portions of said arms of said ball teeing mechanism are complementary tee holding elements located below said circular ball holding elements, said complementary tee holding elements interfitting and cooperating with one another to define a passage for accommodating and holding a tee upright below the golf ball so as to cause the tee to move slightly upwardly toward the golf ball being held between said circular elements when said arms are moved into said capture position.

20. The accessory of claim 10 wherein said coupling means of said actuating mechanism also has a yieldably deformable spring disposed adjacent to said inner end portions of said arms and having opposite ends each respectively attached to one of said inner end portions of said arms such that said spring exerts a force when said arms are disposed at either of said capture position or said release position that tends to hold said arms at said respective positions so that a counterforce must be exerted by a user to move said trigger and said rod therewith in order to overcome the force exerted by said spring and cause said arms to move away from one of said respective positions to the other of said respective positions.

21. The accessory of claim 10 wherein said tee height setting device is mounted to said exterior side of said housing of said ball teeing mechanism for undergoing pivotal movement relative to said housing between an upwardly extending storage position and a downwardly extending use position.

22. A multi-functional golf accessory, comprising:

(a) an elongated shaft having spaced apart upper and lower end portions;

(b) a handle attached to said upper end portion of said shaft;

(c) a ball teeing mechanism including a housing attached to said lower end portion of said shaft and a pair of arms having respective inner end portions disposed interiorly of and mounted to said housing such that said arms are movable relative to said housing and toward and away from one another between capture and release positions, said arms also having respective outer end portions disposed exteriorly of said housing and defining respective elements extending in opposing relation to one another for capturing and holding a golf ball and a tee therebetween when said arms are moved toward one another to said capture position and for releasing the golf ball and tee therefrom when said arms are moved away from one another to said release position;

(d) an actuating mechanism including (i) a finger-actuatable trigger movably mounted to said handle and extending outwardly therefrom, (ii) an elongated rod extending through said shaft and having opposite upper and lower ends, said rod at said upper end movably coupled to said trigger, and (iii) means for movably coupling said lower end of said rod to said inner end portions of said arms of the ball teeing mechanism such that in response to movement of said trigger and said rod therewith in a first direction said arms are moved from said release position to said capture position whereas in response to movement of said trigger and said rod therewith in a second direction opposite to said first direction said arms are moved from said capture position to said release position; and (e) a tee height setting device mounted to an exterior side of said housing of said ball teeing mechanism and being operable to preset the height at which the tee can be implanted into ground by said ball teeing mechanism, said tee height setting device including (i) a mounting bracket mounted to said exterior side of said housing for undergoing pivotal movement relative to said housing between an upwardly extending storage position and a downwardly extending use position;

(ii) a tee height adjusting element mounted to said mounting bracket so as to undergo rotation in order to move said element longitudinally along said mounting bracket, and (iii) a pair of guide pins mounted on said mounting bracket in a generally side-by-side relation with one another and adjacent to said tee height adjusting element and extending outwardly beyond said mounting bracket and said tee height adjusting element such that said guide pins can be pushed into the ground until said tee height adjusting element contacts the ground to set the height at which the tee will be implanted into the ground by the ball teeing mechanism.

23. The accessory of claim 22 wherein said guide pins are also adapted to be inserted into the ground for replacing and repairing divits in a playing surface.

24. The accessory of claim 22 further comprising:

an annular quiver element fitted over said shaft and having at least one radial slit therein; and a ball marking element removably fitted into said one slit of said quiver element, said ball marking element having a tab with an opening which can receive an end of one of said guide pins to place said ball marking element on the ground and also to pick up said ball marking element from the ground.

25. A multi-functional golf accessory, comprising:

(a) an elongated shaft having spaced apart upper and lower end portions;

(b) a handle attached to said upper end portion of said shaft;

(c) a ball teeing mechanism including a housing attached to said lower end portion of said shaft and a pair of arms having respective inner end portions disposed interiorly of and mounted to said housing such that said arms are movable relative to said housing and toward and away from one another between capture and release positions, said arms also having respective outer end portions disposed exteriorly of said housing and defining respective elements extending in opposing relation to one another for capturing and holding a golf ball and a tee therebetween when said arms are moved toward one another to said capture position and for releasing the golf ball and tee therefrom when said arms are moved away from one another to said release position;

(d) an actuating mechanism including (i) a finger-actuatable trigger movably mounted to said handle and extending outwardly therefrom, (ii) an elongated rod extending through said shaft and having opposite upper and lower ends, said rod at said upper end movably coupled to said trigger, and (iii) means for movably coupling said lower end of said rod to said inner end portions of said arms of the ball teeing mechanism such that in response to movement of said trigger and said rod therewith in a first direction said arms are moved from said release position to said capture position whereas in response to movement of said trigger and said rod therewith in a second direction opposite to said first direction said arms are moved from said capture position to said release position;

(e) a tee height setting device mounted to an exterior side of said housing of said ball teeing mechanism and being operable to preset the height at which the tee can be implanted into ground by said ball teeing mechanism; and (f) a ball retrieving device mounted to another exterior side of said housing and pivotally movable between an upper storage position in which said ball retrieving device extends along said shaft and a lower retrieving position in which said ball retrieving device extends beyond said ball teeing mechanism for inserting into a cup to retrieve a ball therefrom.

26. The accessory of claim 25 wherein said ball retrieving device includes:

an elongated member pivotally attached at one end to said housing; and an expandable element attached to an opposite end of said elongated member and being capable of flexing so as to fit around a ball in the cup and underlie the ball for lifting the ball from the cup.

27. The accessory of claim 26 further comprising:

a lying tee retrieving device pivotally mounted to said elongated member of said ball retrieving device and being movable between a storage position adjacent to said elongated member and a use position extending outwardly from said elongated member, said lying tee retrieving device having a bifurcated end portion adapted for receiving a lying tee therethrough.

28. The accessory of claim 26 further comprising:

a standing tee retrieving device fixedly attached to and extending rearwardly outwardly from said opposite end of said elongated member of said ball retrieving device opposite from said expandable element thereon, said standing tee retrieving device having a bifurcated end portion adapted for receiving a standing tee therethrough.

* * * * *